US012492693B2

(12) United States Patent
Dryga

(10) Patent No.: US 12,492,693 B2
(45) Date of Patent: Dec. 9, 2025

(54) SELF CALIBRATING PERISTALTIC PUMP WITH REDUCED FLUID PULSES

(71) Applicant: Q BIOTECH CORP., Rio Rancho, NM (US)

(72) Inventor: Sergey Aleksandrovich Dryga, Rio Rancho, NM (US)

(73) Assignee: Q BIOTECH CORP., Rio Rancho, NM (US)

( * ) Notice: Subject to any disclaimer, the term of this patent is extended or adjusted under 35 U.S.C. 154(b) by 78 days.

(21) Appl. No.: 18/529,989

(22) Filed: Dec. 5, 2023

(65) Prior Publication Data

US 2024/0218867 A1 Jul. 4, 2024

Related U.S. Application Data

(60) Provisional application No. 63/436,087, filed on Dec. 29, 2022.

(51) Int. Cl.
*F04B 43/12* (2006.01)

(52) U.S. Cl.
CPC ..... *F04B 43/1223* (2013.01)

(58) Field of Classification Search
CPC ..... F04B 43/1223
USPC ..... 417/477.1, 476, 477.8, 477.6
See application file for complete search history.

(56) References Cited

U.S. PATENT DOCUMENTS 3,677,667 A * 7/1972 Morrison ..... F04B 43/09 417/474
4,586,882 A * 5/1986 Tseng ..... F04B 43/082 417/474
4,836,752 A * 6/1989 Burkett ..... A61M 5/16859 417/474
4,909,710 A 3/1990 Kaplan et al.
4,954,046 A * 9/1990 Irvin ..... A61M 5/14228 417/474
5,055,013 A * 10/1991 Faeser ..... F04B 43/082 417/474
5,217,335 A 6/1993 Hyman et al.
5,217,355 A * 6/1993 Hyman ..... A61M 5/16854 417/474

(Continued)

OTHER PUBLICATIONS

Internationals Search Report and Written Opinion, PCT/US23/86298, Apr. 26, 2024, 11 pgs.

*Primary Examiner* — Christopher S Bobish
(74) *Attorney, Agent, or Firm* — LOZA & LOZA, LLP; Richard H. Krukar

(57) ABSTRACT

A linear peristaltic pump can include an anvil, a first piston and a second piston. The anvil supports a flexible conduit having a first cavity and a second cavity. The first piston pumps a fluid through the first cavity by repeatedly moving through a first sequence that includes a first cavity filling phase and a first cavity emptying phase. The second piston pumps the fluid through the second cavity by repeatedly moving through a second sequence that includes a second cavity full phase, a second cavity emptying phase that pushes the fluid into the first cavity, a second cavity empty phase that prevents the fluid from flowing into the second cavity, and a second cavity filling phase. The first piston and the second piston may compress the flexible conduit by pressing the flexible conduit against the anvil. The first sequence is a two phase sequence.

15 Claims, 6 Drawing Sheets

(56) References Cited

U.S. PATENT DOCUMENTS

| | | | | |
|---|---|---|---|---|
| 6,213,739 | B1 * | 4/2001 | Phallen | F04B 43/1133 417/474 |
| 6,666,665 | B1 * | 12/2003 | Nguyen | F04B 49/065 417/478 |
| 7,056,475 | B2 * | 6/2006 | Lum | F04B 43/082 422/68.1 |
| 8,142,400 | B2 * | 3/2012 | Rotem | F04B 43/082 604/153 |
| 8,197,234 | B2 * | 6/2012 | Gharib | H02K 41/031 417/474 |
| 8,371,832 | B2 * | 2/2013 | Rotem | F04B 49/065 417/477.7 |
| 9,056,160 | B2 * | 6/2015 | Rotem | F04B 43/0072 |
| 9,553,344 | B2 * | 1/2017 | Masias | H01M 10/625 |
| 9,581,152 | B2 * | 2/2017 | Rotem | F04B 43/0072 |
| 11,162,486 | B2 * | 11/2021 | Powers | F04B 49/06 |
| 2007/0269324 | A1 * | 11/2007 | Goldor | F04B 43/082 417/474 |
| 2008/0170936 | A1 * | 7/2008 | Den Toonder | B01L 3/502746 137/13 |
| 2010/0106082 | A1 * | 4/2010 | Zhou | A61M 5/14232 604/67 |
| 2010/0288382 | A1 * | 11/2010 | Levent | F04B 43/14 137/565.26 |
| 2011/0152831 | A1 * | 6/2011 | Rotem | F04B 49/20 604/153 |
| 2013/0294955 | A1 * | 11/2013 | Katase | F04B 43/08 417/474 |
| 2015/0275886 | A1 * | 10/2015 | Rotem | F04B 43/0072 417/53 |
| 2016/0208792 | A1 * | 7/2016 | Miyamoto | F04B 43/09 |
| 2024/0200548 | A1 * | 6/2024 | Castleman | F04B 43/12 |

* cited by examiner

SELF CALIBRATING PERISTALTIC PUMP WITH REDUCED FLUID PULSES

CROSS REFERENCE TO RELATED APPLICATIONS

This patent application claims the priority and benefit of U.S. provisional patent application 63/436,087 filed Dec. 29, 2022 and titled "SELF-CALIBRATING LINEAR PERISTALTIC PUMP WITH REDUCED FLUID PULSATION". U.S. provisional patent Application No. 63/436,087 is herein incorporated by reference in its entirety.

TECHNICAL FIELD

The systems and methods relate to peristaltic pumps, linear peristaltic pumps, actuators, actuator controllers and sequencers, and to actuator timing and sequencing to reduce the pulsations in a fluid pumped by a peristaltic pump.

BACKGROUND

Linear peristaltic pumps are well known in the art. The principle of action of most linear peristaltic pumps is pushing fluid along a flexible conduit (e.g., a flexible tube or hose) by a wave-like motion of several fingers or pistons arranged in a linear pattern along the conduit. The linear peristaltic pump design addresses several issues characteristic of the circular peristaltic pump, although some issues remain. One of the key performance issues of the peristaltic pump is the pulsating nature of the fluid flow. The pulsation arises due to pressure fluctuation as the wave-like motion of the fingers reaches the end of the pump and the outside finger is lifted. Additionally, the wave-like motion creates an area of increased pressure inside the flexible conduit or tubing between pinch points, thus leading to excessive wear of the flexible conduit. The pulsating nature of the fluid flow is well recognized in the art. The number of fingers that are used in the pump can be increased to reduce the pulsation, with the number of fingers often between 10 and 14. In U.S. Pat. No. 4,909,710, the proposed improvement to reduce the pulsation is to move 2 outside fingers faster than the other fingers resulting in an increased frequency of pulsation with smaller magnitude.

BRIEF SUMMARY OF SOME EXAMPLES

The following presents a summary of one or more aspects of the present disclosure, in order to provide a basic understanding of such aspects. This summary is not an extensive overview of all contemplated features of the disclosure and is intended neither to identify key or critical elements of all aspects of the disclosure nor to delineate the scope of any or all aspects of the disclosure. Its sole purpose is to present some concepts of one or more aspects of the disclosure as a prelude to the more detailed description that is presented later.

An aspect of the subject matter described in this disclosure can be implemented by a system. The system can include an anvil operable to support a flexible conduit having a first cavity and a second cavity, a first piston operable to pump a fluid through the first cavity by repeatedly moving through a first sequence that includes a first cavity filling phase and a first cavity emptying phase, and a second piston operable to pump the fluid through the second cavity by repeatedly moving through a second sequence that includes a second cavity full phase, a second cavity emptying phase that pushes the fluid into the first cavity, a second cavity empty phase that prevents the fluid from flowing into the second cavity, and a second cavity filling phase, wherein the first piston and the second piston are operable to compress the flexible conduit by pressing the flexible conduit against the anvil, and the first sequence is a two phase sequence.

Another aspect of the subject matter described in this disclosure can be implemented in a method. The method can include using a first piston to compress and release a first cavity of the flexible conduit by repeatedly moving the first piston through a first sequence that includes a first cavity filling phase and a first cavity emptying phase, and using a second piston to compress and release a second cavity of the flexible conduit by repeatedly moving the second piston through a second sequence that includes a second cavity full phase, a second cavity emptying phase that pushes the fluid into the first cavity, a second cavity empty phase that prevents the fluid from flowing into the second cavity, and a second cavity filling phase.

Yet another aspect of the subject matter described in this disclosure can be implemented by a system device. The system can include a first pumping means for compressing and releasing a first cavity of a flexible conduit in a first sequence that includes a first cavity filling phase and a first cavity emptying phase, and a second pumping means for compressing and releasing a second cavity of the flexible conduit by repeatedly moving through a second sequence that includes a second cavity full phase, a second cavity emptying phase that pushes a fluid into the first cavity, a second cavity empty phase that prevents the fluid from flowing into the second cavity, and a second cavity filling phase.

In some implementations of the methods and devices, the second cavity full phase and the second cavity emptying phase coincide with the first cavity filling phase. In some implementations of the methods and devices, the second cavity filling phase does not coincide with the first cavity filling phase. In some implementations of the methods and devices, the system further includes a third piston operable to pump the fluid through a third cavity of the flexible conduit by moving through a third sequence that includes a third cavity emptying phase that pushes the fluid into the first cavity via the second cavity, a third cavity empty phase that prevents the fluid from flowing into the third cavity, a third cavity filling phase, and a third cavity full phase. In some implementations of the methods and devices, the fluid is pushed into the first cavity during the second cavity emptying phase in response to the third piston holding the third cavity closed during the second cavity emptying phase. In some implementations of the methods and devices, the system further includes a fourth piston operable to pump the fluid through a fourth cavity of the flexible conduit by moving through a fourth sequence that includes a fourth cavity empty phase that prevents the fluid from flowing into the fourth cavity, a fourth cavity filling phase, a fourth cavity full phase, and fourth cavity emptying phase that pushes the fluid into the second cavity via the third cavity.

In some implementations of the methods and devices, the fluid is pushed into the first cavity during the third cavity emptying phase in response to the fourth piston holding the fourth cavity closed during the third cavity emptying phase. In some implementations of the methods and devices, the system further includes a fifth piston operable to pump the fluid through a fifth cavity of the flexible conduit by moving through a fifth sequence that includes a fifth cavity filling phase, a fifth cavity full phase, a fifth cavity emptying phase that pushes the fluid into the third cavity via the fourth cavity, and a fifth cavity empty phase that prevents the fluid from flowing into the fifth cavity. In some implementations of the methods and devices, the fluid is pushed into the second cavity during the fourth cavity emptying phase in response to the fifth piston holding the fifth cavity closed during the fourth cavity emptying phase. In some implementations of the methods and devices, the third cavity emptying phase coincides with the second cavity full phase, the fourth cavity empty phase, and the fifth cavity filling phase, the second cavity emptying phase coincides with the third cavity empty phase, the fourth cavity filling phase, and the fifth cavity full phase, and the third cavity emptying phase and the second cavity emptying phase coincide with the first cavity filling phase.

In some implementations of the methods and devices, the system further includes an actuator operable to apply an actuator force to a piston to move the piston to a cavity empty position, a force sensor operable to produce a measurement of the actuator force, and an actuator calibrator operable to use the measurement of actuator force to determine an empty cavity position parameter that indicates the cavity empty position. In some implementations of the methods and devices, the system further includes a memory operable to store a plurality of conduit descriptions that includes a conduit description that is associated with the flexible conduit, and an actuator sequencer operable to control an actuator that moves the first piston to a cavity empty position and to a cavity full position, wherein the conduit description that is associated with the flexible conduit includes an empty cavity position parameter and a full cavity position parameter, and the actuator sequencer is operable to use the empty cavity position parameter to determine the cavity empty position and to use the full cavity position parameter to determine the cavity full position.

In some implementations of the methods and devices, the method further includes using a third piston to compress and release a third cavity of the flexible conduit by repeatedly moving the third piston through a third sequence that includes a third cavity emptying phase that pushes the fluid into the first cavity via the second cavity, a third cavity empty phase that prevents the fluid from flowing into the third cavity, a third cavity filling phase, and a third cavity full phase, wherein the fluid is pushed into the first cavity during the second cavity emptying phase in response to the third piston pressing the third cavity closed during the second cavity emptying phase. In some implementations of the methods and devices, the method further includes using a fourth piston to compress and release a fourth cavity of the flexible conduit by repeatedly moving the fourth piston through a fourth sequence that includes a fourth cavity empty phase that prevents the fluid from flowing into the fourth cavity, a fourth cavity filling phase, a fourth cavity full phase, and fourth cavity emptying phase that pushes the fluid into the second cavity via the third cavity, wherein the fluid is pushed into the first cavity during the third cavity emptying phase in response to the fourth piston pressing the fourth cavity closed during the third cavity emptying phase. In some implementations of the methods and devices, the method further includes applying an actuator force to a piston to move the piston to a cavity empty position, producing a measurement of the actuator force, and using the measurement of actuator force to determine an empty cavity position parameter that indicates the cavity empty position. In some implementations of the methods and devices, the method further includes storing a conduit description that is associated with the flexible conduit and that includes the empty cavity position parameter and a full cavity position parameter, using the empty cavity position parameter to determine a cavity empty position for the first piston, and using the full cavity position parameter to determine a cavity full position for the first piston. In some implementations of the methods and devices, the method further includes the third cavity emptying phase coincides with the second cavity full phase, and the fourth cavity empty phase, the second cavity emptying phase coincides with the third cavity empty phase, and the fourth cavity filling phase, and the third cavity emptying phase and the second cavity emptying phase coincide with the first cavity filling phase.

In some implementations of the methods and devices, the system further includes a third pumping means for compressing and releasing a third cavity of the flexible conduit in a third sequence that includes a third cavity emptying phase that pushes the fluid into the first cavity via the second cavity, a third cavity empty phase that prevents the fluid from flowing into the third cavity, a third cavity filling phase, and a third cavity full phase.

These and other aspects will become more fully understood upon a review of the detailed description, which follows. Other aspects and features will become apparent to those of ordinary skill in the art, upon reviewing the following description of specific examples in conjunction with the accompanying figures. While features may be discussed relative to certain examples and figures below, any example may include one or more of the advantageous features discussed herein. In other words, while one or more examples may be discussed as having certain advantageous features, one or more of such features may also be used in accordance with the various examples discussed herein. In similar fashion, while the examples may be discussed below as devices, systems, or methods, the examples may be implemented in various devices, systems, and methods.

BRIEF DESCRIPTION OF THE DRAWINGS

Throughout the description, similar reference numbers may be used to identify similar elements.

DETAILED DESCRIPTION

Figure 1:
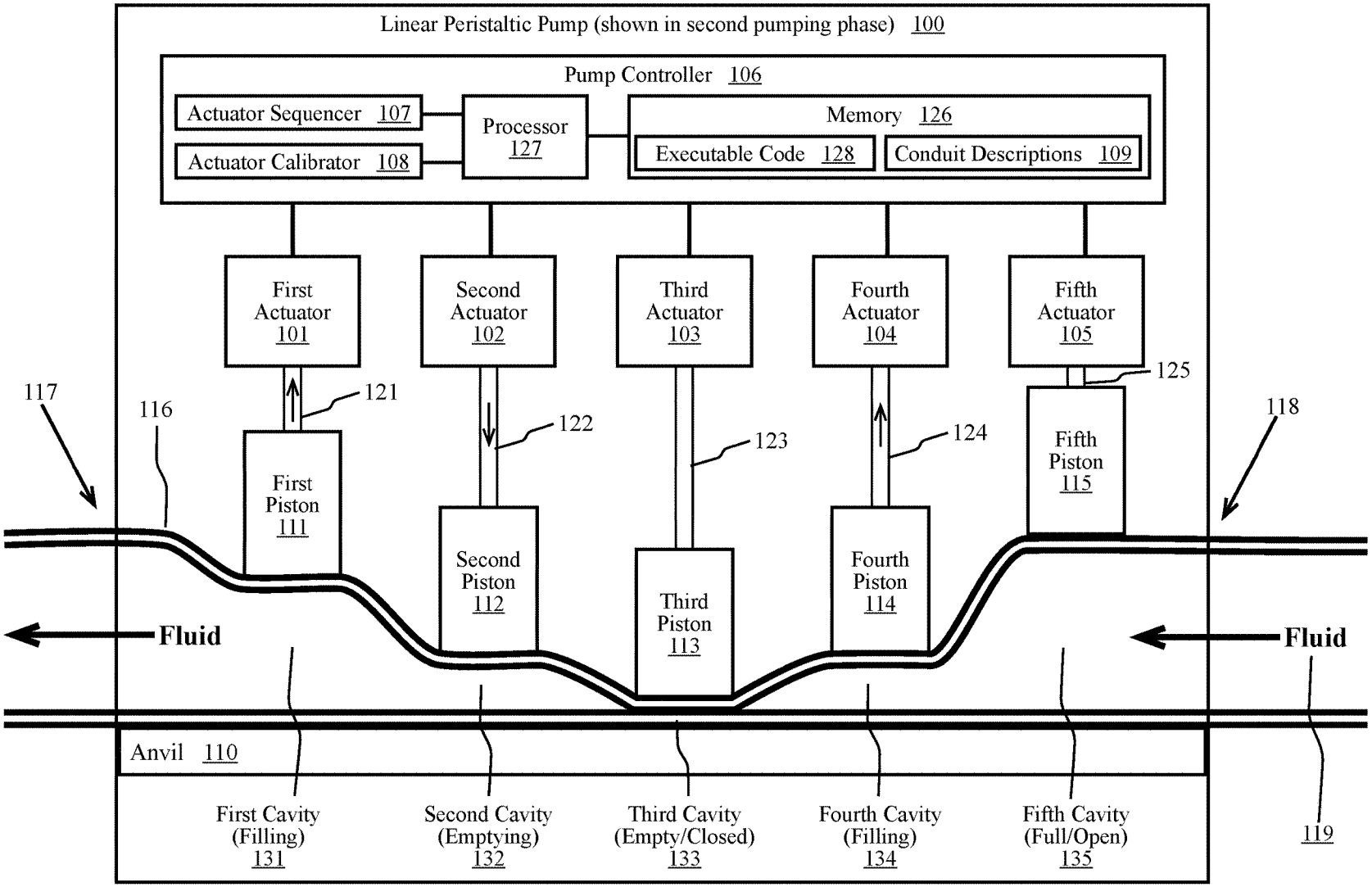
FIG. 1 is a high-level conceptual diagram illustrating an example of a linear peristaltic pump, according to some aspects.

It will be readily understood that the components of the examples as generally described herein and illustrated in the appended figures could be arranged and designed in a wide variety of different configurations. Thus, the following more detailed description of various examples, as represented in the figures, is not intended to limit the scope of the present disclosure, but is merely representative of various examples. While the various aspects of the examples are presented in drawings, the drawings are not necessarily drawn to scale unless specifically indicated.

Systems and methods that implement aspects may have various differing forms. The described systems and methods are to be considered in all respects only as illustrative and not restrictive. The scope of the claims is, therefore, indicated by the claims themselves rather than by this detailed description. All changes which come within the meaning and range of equivalency of the claims are to be embraced within their scope.

Reference throughout this specification to features, advantages, or similar language does not imply that any system or method implements each and every aspect that may be realized. Rather, language referring to the features and advantages is understood to mean that a specific feature, advantage, or characteristic described in an example may be implemented in or by at least one example. Thus, discussions of the features and advantages, and similar language, throughout this specification may but do not necessarily, refer to the same example.

Furthermore, the described features, advantages, characteristics, and aspects may be combined in any suitable manner in one or more systems or methods. One skilled in the relevant art will recognize, in light of the description herein, that one example may be practiced without one or more of the specific features or advantages of another example. In other instances, additional features and advantages may be recognized in one example that may not be present in all the examples.

Reference throughout this specification to "one example", "an example", or similar language means that a particular feature, structure, or characteristic described in connection with the indicated example is included in at least one example. Thus, the phrases "in one example", "in an example", and similar language throughout this specification may but do not necessarily, all refer to the same example.

Typical linear peristaltic pumps utilize a number of pistons (often called fingers), commonly 8 to 14 pistons, that can compress a flexible conduit against an anvil (e.g., a steel plate, plastic block, etc.). The area of a flexible conduit that is between a piston and the anvil may be referred to as a cavity. During a cavity emptying phase, the piston may compress the flexible conduit by pressing the flexible conduit against the anvil until all the fluid has been forced from the cavity. During a cavity filling phase, the piston may release the flexible conduit by moving away from the anvil until the cavity has filled with fluid. Prior art peristaltic pumps actuate the pistons in a wave-like pattern to thereby move an occlusion zone along the flexible conduit. The occlusion zone includes numerous contiguous cavities (e.g., five contiguous cavities). The actuation may be provided by a cam shaft with cams that provide the specific pattern by pushing the pistons into the flexible conduit. U.S. Pat. No. 10,519,946 discloses an alternative mechanism that uses a piezo-driven lever to move the occlusion zone along the conduit. These mechanisms create a pulsating flow. There have been efforts to decrease the size of the pulses in the flow. In U.S. Pat. No. 4,909,710, the approach to reduce the pulsations in the flow is to move the fingers closest to the pump output at twice the rate of other fingers shortening the outside finger reduces the amount of compression applied to the tube by the outside finger. The previous designs have limited adjustability. For example, the travel distance of each finger of a cam shaft driven pump is predetermined by the design of the cams of the cam shaft and is difficult to adjust in the field.

A peristaltic pump can have a separate actuator for each piston. Examples of such actuators include servo motors, stepper motors, piezo drivers, and other actuators. An aspect of the pump is that each actuator may move one of the pistons from the piston's current position to a dynamically controlled final position. As such, different sizes of flexible conduit may be accommodated by changing the pistons' ranges of motion. For example, the pump may be calibrated for a flexible conduit having a 12 mm outer diameter and 1.5 mm thick sidewalls such that the piston is moved to a position that is 3 mm from the anvil during the cavity emptying phase and is moved to a position that is 12 mm from the anvil during the cavity filling phase. The pump may then be recalibrated for a flexible conduit having a 10 mm outer diameter and 1 mm thick sidewalls such that the piston is moved to a position that is 2 mm from the anvil during the cavity emptying phase and is moved to a position that is 10 mm from the anvil during the cavity filling phase. The final position of the piston may be dynamically controlled such that the final position is set by an electronic signal (e.g., the magnitude of a servo input signal, the number of steps for a stepper motor, etc.). The calibration for different flexible conduits may be determined by measuring the force required to move the piston because the flexible conduit resists compression, especially when the cavity is fully compressed and the opposing sidewalls are pressed together Those practiced in actuators and controllers for actuators are familiar with dynamically controlling actuators. For example, a stepper motor with a stepper motor controller may be dynamically controlled by commanding a stepper motor controller to move a specific number of steps in a specific direction. Furthermore, the movement profile such as the acceleration, deceleration, and movement rate may be set. Other types of dynamically controlled actuators may be similarly controlled. As such, those practiced in the art of mechanical controls are familiar with techniques and methods that, in light of the teachings herein, may be used for controlling the velocity, acceleration, and position of a piston that is attached to an actuator. Those practiced in the art of mechanical controls are also familiar with techniques and methods for coordinating the movement of multiple actuators or pistons.

A peristaltic pump may produce a nearly pulse free and even fluid flow by moving the pistons through multistage sequences. In one example, the peristaltic pump has five pistons with the piston nearest the pump output moving through a two phase sequence while the other pistons move through four phase sequences. The two phase sequence includes a cavity filling phase and a cavity emptying phase. The four phase sequences include a cavity filling phase, a cavity full phase, a cavity emptying phase, and a cavity empty phase. A piston compresses a cavity during a cavity emptying phase to force fluid out of the cavity until the cavity is empty. The piston holds the flexible conduit completely compressed during the cavity empty phase to keep the cavity empty and to prevent fluid from flowing through the cavity. The piston lifts from the flexible conduit during the cavity filling phase, thereby releasing the flexible conduit from compression. The piston allows the cavity to stay full during the cavity full phase.

The pistons for a peristaltic pump may be individually controlled to thereby coordinate the movements and positions of the pistons. Each piston is positioned to compress a length of a flexible conduit. The length of the flexible tubing that is compressed by the piston is herein called a cavity. Compressing the cavity during an emptying phase pumps fluid out of the cavity. Lifting the piston away from the flexible conduit allows the flexible conduit to fill with fluid from an adjoining cavity or section of the flexible conduit. The first cavity is the cavity nearest the pump output and is compressed by the first piston. The second cavity is compressed by the second piston and is between the first cavity and a third cavity, the third cavity is compressed by the second piston and is between the first cavity and a third cavity, and so forth. The last cavity is compressed by the last piston and is between the next to last cavity and the pump input. The pistons can be moved through sequences of phases such that the fluid flow produced by the pump is nearly pulse free. The actuators driving the pistons may be directly controllable such that the pump can accommodate different sizes of flexible conduit by selecting the calibration associated with each size of flexible conduit. In addition, the peristaltic pump may be automatically calibrated for a flexible conduit by monitoring the force that a piston applies to the flexible conduit.

FIG. 1 is a high-level conceptual diagram illustrating an example of a linear peristaltic pump 100, according to some aspects. The linear peristaltic pump 100 includes a pump controller, pistons 111-115, control rods 121-125, actuators 101-105 that drive the pistons 111-115 via the control rods 121-125, an anvil 110, a pump input 118, and a pump output 117. A flexible conduit 116 is installed in the linear peristaltic pump 100 between the pistons and the anvil 110. The anvil supports the flexible conduit such that the pistons can compress the flexible conduit by pressing the flexible conduit against the anvil. A fluid 119 flowing through the flexible conduit 116 can flow into the linear peristaltic pump 100 via the pump input 118 and can flow out of the linear peristaltic pump 100 via the pump output 117. The pump controller 106 may control the positions and movements of the actuators to thereby control the positions and movements of the pistons. The pump controller 106 may be or may include a computer that includes a processor 127 and a memory 126. A computer may be operable to control driver circuits powering the actuators to thereby control the actuators as is notoriously well known. The pump controller may therefore be implemented using such a computer and such driver circuits. The pump controller 106 can include an actuator sequencer 107, an actuator calibrator 108, and a memory 126 operable to store conduit descriptions 109 and executable code 128. The executable code 128 (e.g., compiled or interpreted computer programs) may be executed by the processor 127 to thereby implement aspects of the actuator sequencer 107 and actuator calibrator 108. The actuator sequencer controls and coordinates the movements of the actuators to thereby drive the pistons through multi-phase sequences. It is by driving the pistons through the multi-phase sequences that the fluid 119 is pumped through the linear peristaltic pump 100.

The actuators include a first actuator 101, a second actuator 102, a third actuator 103, a fourth actuator 104, and a fifth actuator 105. The control rods include a first control rod 121 that is driven by the first actuator 101, a second control rod 122 that is driven by the second actuator 102, a third control rod 123 that is driven by the third actuator 103, a fourth control rod 124 that is driven by the fourth actuator 104, and a fifth control rod 125 that is driven by the fifth actuator 105. The control rods may be attached to the pistons such that an actuator can drive a piston by driving a control rod. Other examples may have pistons that are driven directly by the actuators. Yet other examples may have a single mechanism that is equivalent to a combination of a piston and an actuator (e.g., a linear stepper motor with an integral piston). Still yet other examples may have pistons that are indirectly driven by the actuators via other mechanisms such as levers, etc.

The pistons include a first piston 111 that is driven by the first actuator 101 via the first control rod 121, a second piston 112 that is driven by the second actuator 102 via the second control rod 122, a third piston 113 that is driven by the third actuator 103 via the third control rod 123, a fourth piston 114 that is driven by the fourth actuator 104 via the fourth control rod 124, and a fifth piston 115 that is driven by the fifth actuator 105 via the fifth control rod 125. The areas between the pistons and the anvil 110 define cavities in the flexible conduit 116. The cavities include a first cavity 131, a second cavity 132, a third cavity 133, a fourth cavity 134, and a fifth cavity 135. The first cavity 131 in the flexible conduit 116 is between the first piston 111 and the anvil 110. The second cavity 132 in the flexible conduit 116 is between the second piston 112 and the anvil 110. The third cavity 133 in the flexible conduit 116 is between the third piston 113 and the anvil 110. The fourth cavity 134 in the flexible conduit 116 is between the fourth piston 114 and the anvil 110. The fifth cavity 135 in the flexible conduit 116 is between the fifth piston 115 and the anvil 110.

Figure 2:
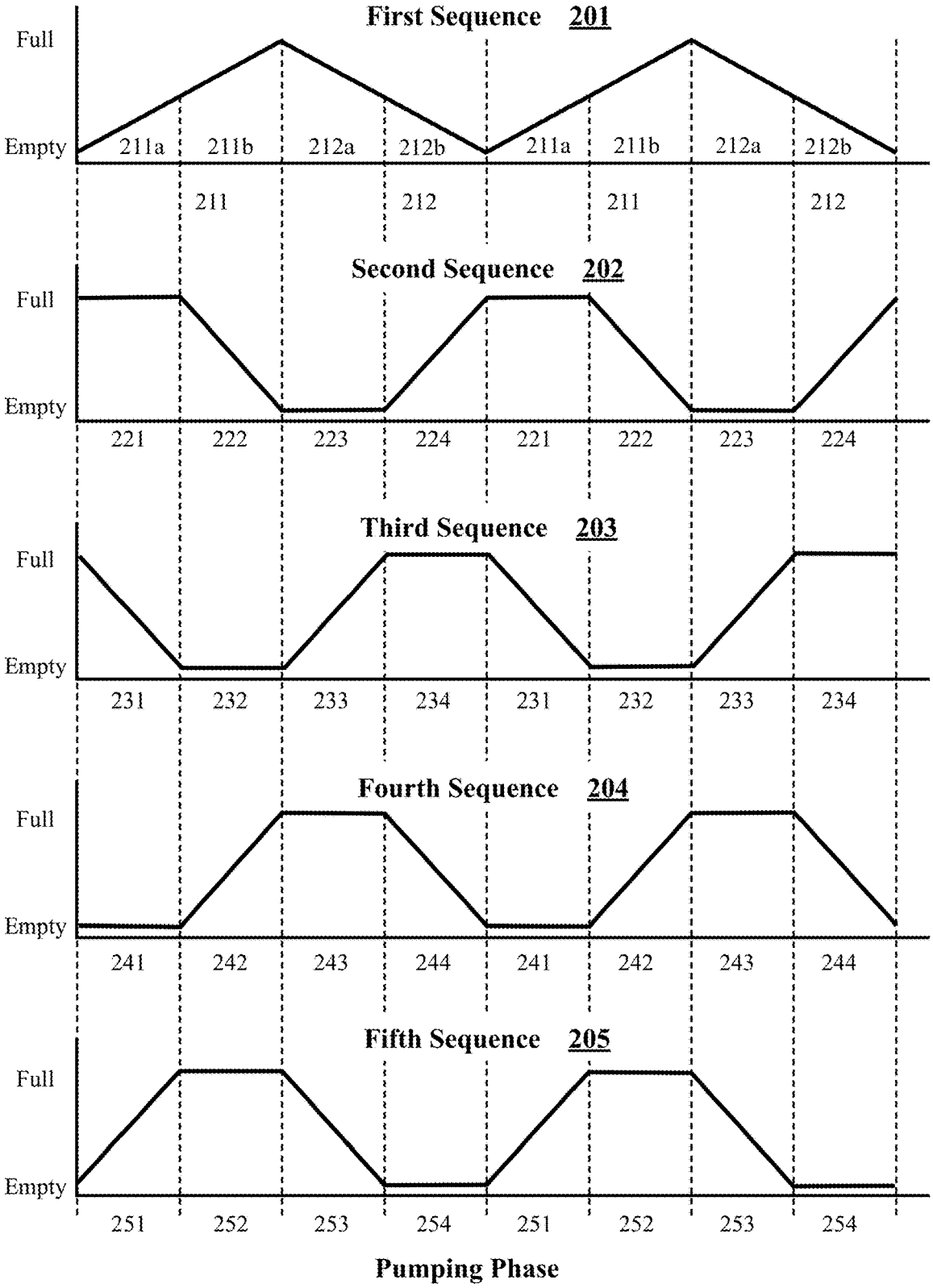
FIG. 2 is a high-level flow diagram illustrating sequences of pumping phases that may be used by the linear peristaltic pump shown in FIG. 1, according to some aspects.

FIG. 2 is a high-level flow diagram illustrating an example of sequences 201-205 of pumping phases that may be used by the linear peristaltic pump shown in FIG. 1, according to some aspects. The sequences illustrated in FIG. 2 may be used to drive the pistons 111-115 to produce a fluid flow that is completely or nearly pulse free. The sequences include a first sequence 201 for the first piston 111, a second sequence 202 for the second piston 112, a third sequence 203 for the third piston 113, a fourth sequence 204 for the fourth piston 114, and a fifth sequence 205 for the fifth piston 115. The first sequence 201 is a two-phase sequence in which the first piston 111 repeatedly moves from a first cavity filling phase 211 to a first cavity emptying phase 212. The second sequence 202 is a four-phase sequence in which the second piston 112 repeatedly moves from a second cavity full phase 221 to a second cavity emptying phase 222 to a second cavity empty phase 223 to a second cavity filling phase 224. The third sequence 203 is a four-phase sequence in which the third piston 113 repeatedly moves from a third cavity emptying phase 231 to a third cavity empty phase 232 to a third cavity filling phase 233 to a third cavity full phase 234. The fourth sequence 204 is a four-phase sequence in which the fourth piston 114 repeatedly moves from a fourth cavity empty phase 241 to a fourth cavity filling phase 242 to a fourth cavity full phase 243 to a fourth cavity emptying phase 244. The fifth sequence 205 is a four-phase sequence in which the fifth piston 115 repeatedly moves from a fifth cavity filling phase 251 to a fifth cavity full phase 252 to a fifth cavity emptying phase 253 to a fifth cavity empty phase 254.

Let D be the desired rate at which fluid flows from the pump. The pump can produce a fluid flow at the desired rate, D, by coordinating the sequences through which the pistons are moved. As such, specific phases of each sequence may coincide with specific phases of the other sequences. Coincide means "occur at or during the same time". Observing the first sequence, it is seen that the first cavity is filling during the first cavity filling phase 211. In order to maintain the desired out flow, fluid must be pumped into the first cavity at a rate equaling D plus the rate required to fill the first cavity during the first cavity filling phase. As such, the first half of the first cavity filling phase 211*a* can coincide with the second cavity full phase 221, the third cavity emptying phase 231, the fourth cavity empty phase 241, and the fifth cavity filling phase 251. Fluid is pushed out of the third cavity at a rate of 2D while the fourth cavity is held closed (cavities in the "empty" phase are held closed) and the second cavity is full. The result is that the third piston is pumping fluid into the first cavity and out of the pump such that the first cavity fills and the pump's output flow remains steady. Holding the fourth cavity closed ensures that the fluid is pumped from the third cavity toward the pump output. The fifth cavity may be allowed to fill during the first cavity filling phase while the fourth cavity is held closed. If the third cavity is the same size as the first cavity, as in the illustrated example, then the third cavity is emptied halfway through the first cavity filling phase.

The second half of the first cavity filling phase 211*b* can coincide with the second cavity emptying phase 222, the third cavity empty phase 232, the fourth cavity filling phase 242, and the fifth cavity full phase 252. Fluid is pushed out of the second cavity at a rate of 2D while the third cavity is held closed. The result is that the second piston is pumping fluid into the first cavity and out of the pump such that the first cavity fills and the pump's output flow remains steady. If the second cavity is the same size as the first cavity, as in the illustrated example, then the second cavity is emptied when the first cavity filling phase completes. The fourth cavity may be allowed to fill during the first cavity filling phase while the third cavity is held closed and while the fifth cavity is full or filling.

The first cavity is full and the second cavity is held closed at the end of the first cavity filling phase. The pump's output flow may therefore be maintained by pumping fluid out of the first cavity while the closed second cavity prevents back flow. The first half of the first cavity emptying phase 212*a* can coincide with the second cavity empty phase 223, the third cavity filling phase 233, the fourth cavity full phase 243, and the fifth cavity emptying phase 253. The third cavity is allowed to fill during the first half of the first cavity emptying phase such that the third cavity is full when the next first cavity emptying phase begins. The fifth cavity is emptied during the first half of the first cavity emptying phase to pump fluid into the third cavity and to prevent backflow during the second half of the first cavity emptying phase. The desired outflow could be maintained until the end of the first cavity emptying phase by completely emptying the first cavity while holding the second cavity closed. However, the subsequent first cavity filling phase must begin with the second cavity full. The second cavity must therefore be filled during the second half of the first cavity emptying phase.

The second half of the first cavity emptying phase 212*b* can coincide with the second cavity filling phase 224, the third cavity full phase 234, the fourth cavity emptying phase 244, and the fifth cavity empty phase 254. The fifth cavity is held closed to prevent backflow while the fourth cavity is emptied to thereby fill the second cavity. The second cavity is full, the third cavity is full, and the fourth cavity is held closed at the end of the first cavity filling phase. The pump is therefore ready for the next first cavity filling phase.

Figure 3:
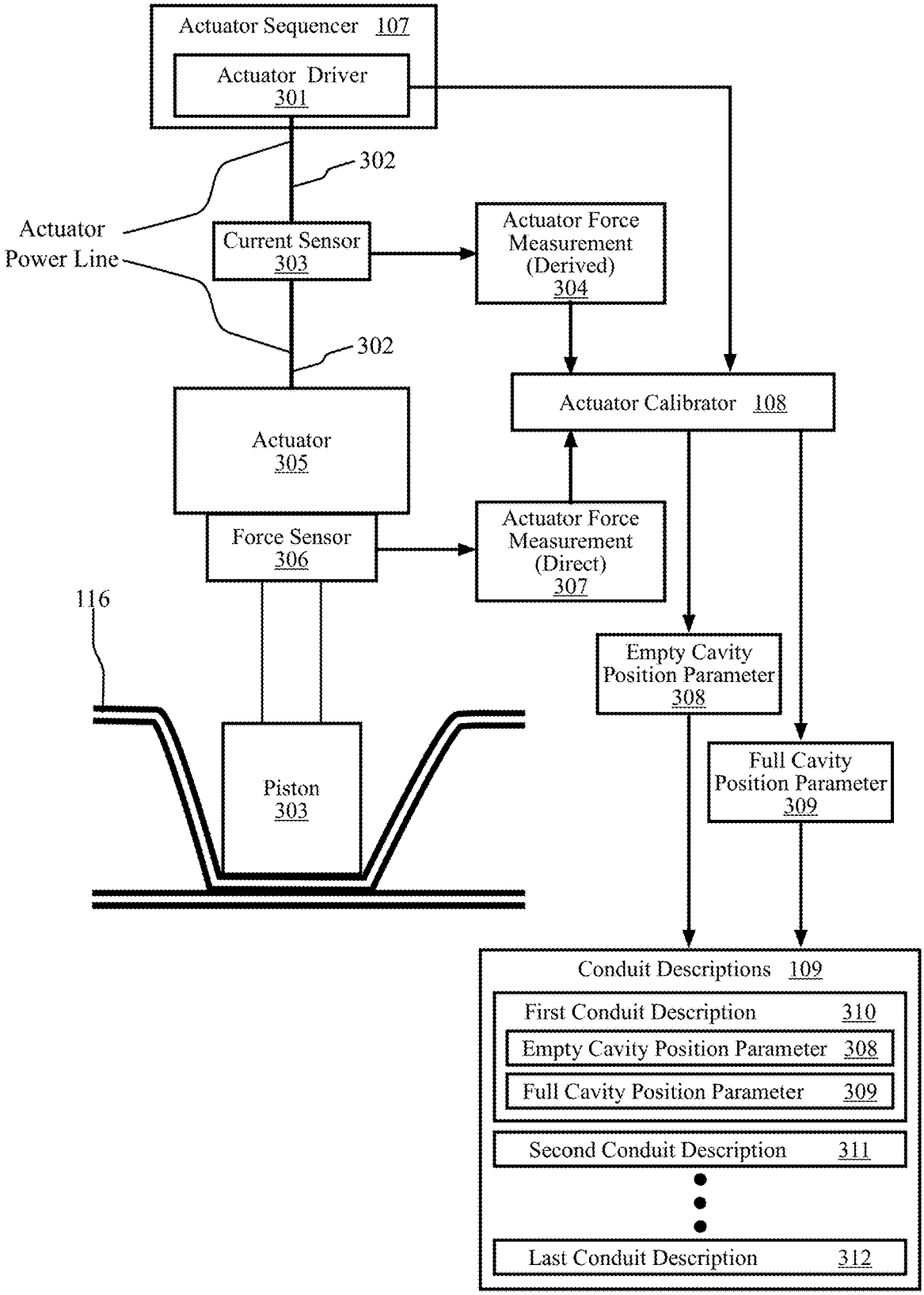
FIG. 3 is a high-level conceptual diagram illustrating self calibration of a pumping stage of a linear peristaltic pump, according to some aspects.

FIG. 3 is a high-level conceptual diagram illustrating self calibration of a pumping stage of a linear peristaltic pump, according to some aspects. The linear peristaltic pump may be automatically calibrated after positioning a flexible conduit between the anvil and the pistons. Such calibration may define the positions of the pistons during cavity full phases and during cavity empty phases. The piston position during a cavity full phase may be the endpoint of the piston's movement during a cavity filling phase. The piston position during a cavity empty phase may be the endpoint of the piston's movement during a cavity emptying phase.

The actuator sequencer may include or control an actuator driver 301. The actuator driver 301 may provide electric power to an actuator 305 that is driving a piston 303 by applying an actuator force to the piston. The force required for moving the piston 303 is a function of the resistance to moving the piston 303. When moving the piston toward the anvil, the force required is lowest when the piston is above the flexible conduit 116. The force required increases when the piston starts compressing the flexible conduit 116. The force required jumps when the flexible conduit is fully compressed. The cavity under the piston is empty when the flexible conduit is fully compressed. Further force compresses the sidewalls of the flexible conduit and may damage the flexible conduit.

The force required to move the piston may be measured directly by a force sensor 306 (e.g., load cell, force sensing resistor, etc.) or may be measured indirectly by measuring the electric power that the actuator driver provides to the actuator though actuator power lines 302. For example, the electric power provided to the actuator may be increased by increasing the electric current of the driving signal. As such, a current sensor may provide an indirect measurement of the force required to move the piston 303. The force sensor 306 may provide an actuator force measurement 307 that is a direct measurement. The current sensor 304 may provide an actuator force measurement that is indirect. Such a current measurement may be used as an actuator force measurement because the current that is measured may be proportional to or a function of the actuator force. In some implementations, a voltage measurement may be used as an indirect measurement of the actuator force. An actuator calibrator 108 may receive an actuator force measurement and an actuator position measurement. The actuator position measurement may be provided by the actuator driver 301, by a sensor that measures the actuator position, etc. The actuator calibrator 108 can track the actuator force as a function of piston/actuator position to thereby determine an empty cavity position parameter 308 and a full cavity position parameter 309. The empty cavity position parameter 308 and the full cavity position parameter 309 can be stored in a conduit description (e.g., the first conduit description 310) in the conduit descriptions 109 stored by the pump controller 106. The conduit descriptions 109 can include the first conduit description 310, a second conduit description 311, a last conduit description 312, and many conduit descriptions between the second and the last. The pump controller can store conduit descriptions for the flexible conduits that may be installed in the pump and used for pumping fluid. When a new flexible conduit is installed, the pump may automatically calibrate itself for the new flexible conduit and then proceed to pump fluid. Alternatively, an operator may select a conduit description for a new flexible conduit when the new flexible conduit is installed to thereby calibrate for the new flexible conduit before proceeding to pump fluid.

Figure 4:
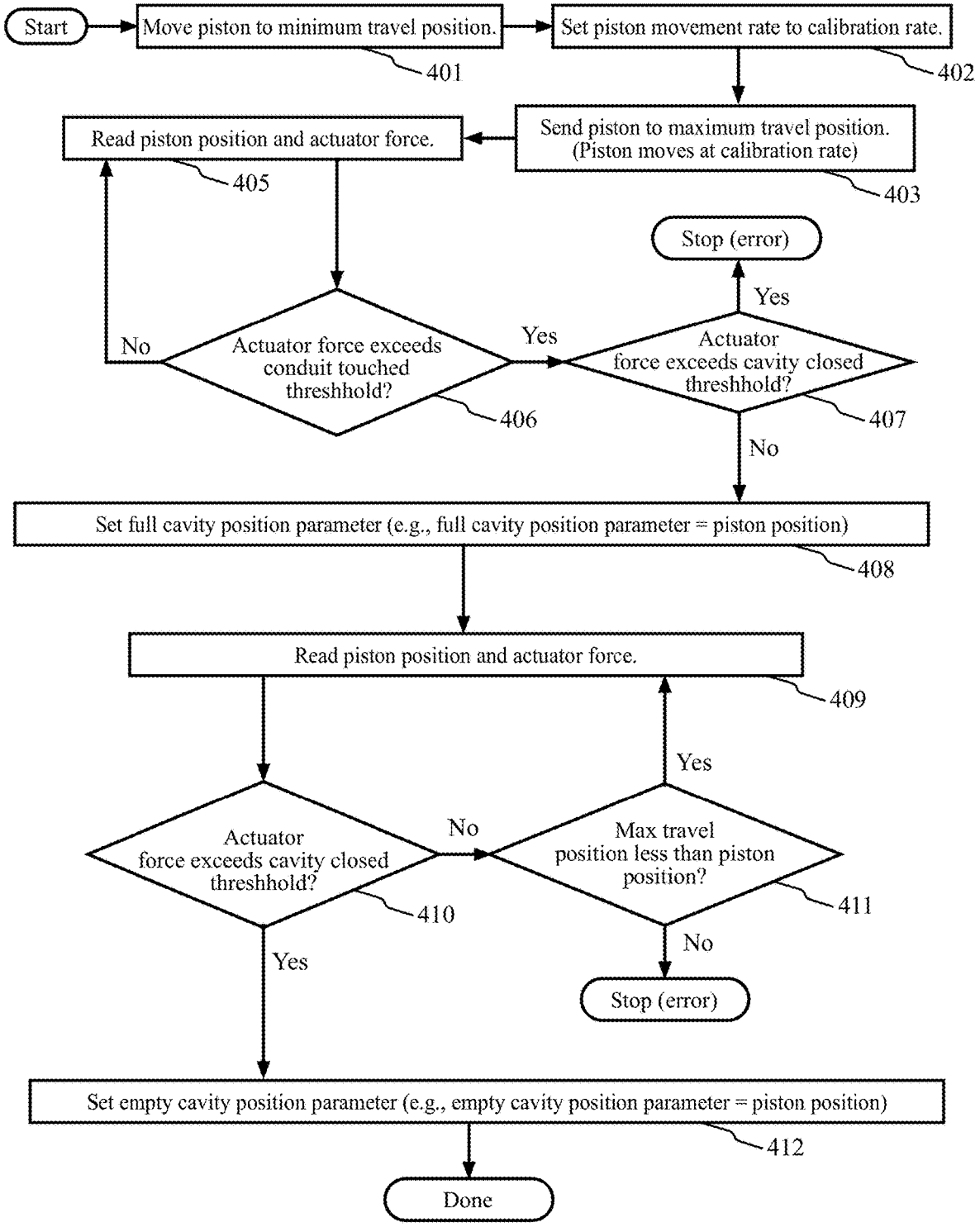
FIG. 4 is a high-level flow diagram illustrating an example of a self calibration process for calibrating a pumping stage of a linear peristaltic pump, according to some aspects.

FIG. 4 is a high-level flow diagram illustrating an example of a self calibration process for calibrating a pumping stage of a linear peristaltic pump, according to some aspects. The illustrated example may be used for systems in which the movement speed of the piston/actuator is set before a move-to command is issued to send the piston/actuator to a specific position. This is but one of the many movement control systems known by those practiced in the art. The example presented here may be easily adapted to those other systems with minimal experimentation and a great likelihood of success. After the start, at block 401 the piston may be moved to a minimum travel position. The minimum travel position can be the furthest position from the anvil to which the piston can move. At block 402, the piston movement rate may be set to a calibration rate. The calibration rate may be lower than the rate used for pumping such that position measurements may be more precisely known. At block 403, the piston may be sent to the maximum travel position. The maximum travel position may be the anvil location or even a position beyond the anvil. The piston is now moving at the calibration rate from the minimum travel position to the maximum travel position. The piston position and the actuator force may be repeatedly measured to detect when the piston begins compressing the flexible conduit. At block 405, the piston/actuator position and the actuator force (the force needed to move the piston) is measured. At decision block 406, the actuator force can be compared to a conduit touched threshold. The conduit touched threshold can be a value between the force needed to freely move the piston/actuator and the force needed to compress a flexible conduit. The process may loop back to block 405 if the actuator force does not exceed the conduit touched threshold. Otherwise, the process may continue to decision block 407. At decision block 407, the actuator force can be compared to a cavity closed threshold. The cavity closed threshold can be a value between the force needed to compress a flexible conduit and the force needed to crush the flexible conduit against the anvil. The process may continue to block 408 if the actuator force does not exceed the cavity closed threshold. Otherwise, the process may stop because an error has been detected. For example, the error may be that the piston has seized, the mechanism is blocked, or no flexible conduit is positioned between the piston and the anvil. At block 408, the cavity full position parameter may be set. For example, the cavity full position parameter may be set to equal the current position of the piston/actuator. The position corresponding to the cavity full position parameter may be the position that the piston moves to during a cavity filling phase. The flexible tubing is now being compressed and the piston position and the actuator force may be repeatedly measured to detect when the flexible conduit is fully compressed. At block 409, the piston/actuator position and the actuator force (the force needed to move the piston) is measured. At decision block 410, the actuator force can be compared to the cavity closed threshold. The process may move to decision block 411 if the actuator force does not exceed the conduit touched threshold. Otherwise, the process may continue to block 412. At decision block 411, the maximum travel position is compared to the piston/actuator position. If the maximum travel position is less than the piston/actuator position then the process may loop back to block 409. Otherwise, the process may stop because an error has been detected. For example, an error may have occurred because the piston/actuator should not reach this position before encountering the anvil. At block 412, the empty cavity position parameter may be set. For example, the empty cavity position parameter may be set to equal the current position of the piston/actuator. The position corresponding to the empty cavity position parameter may be the position that the piston moves to during a cavity emptying phase.

Figure 5:
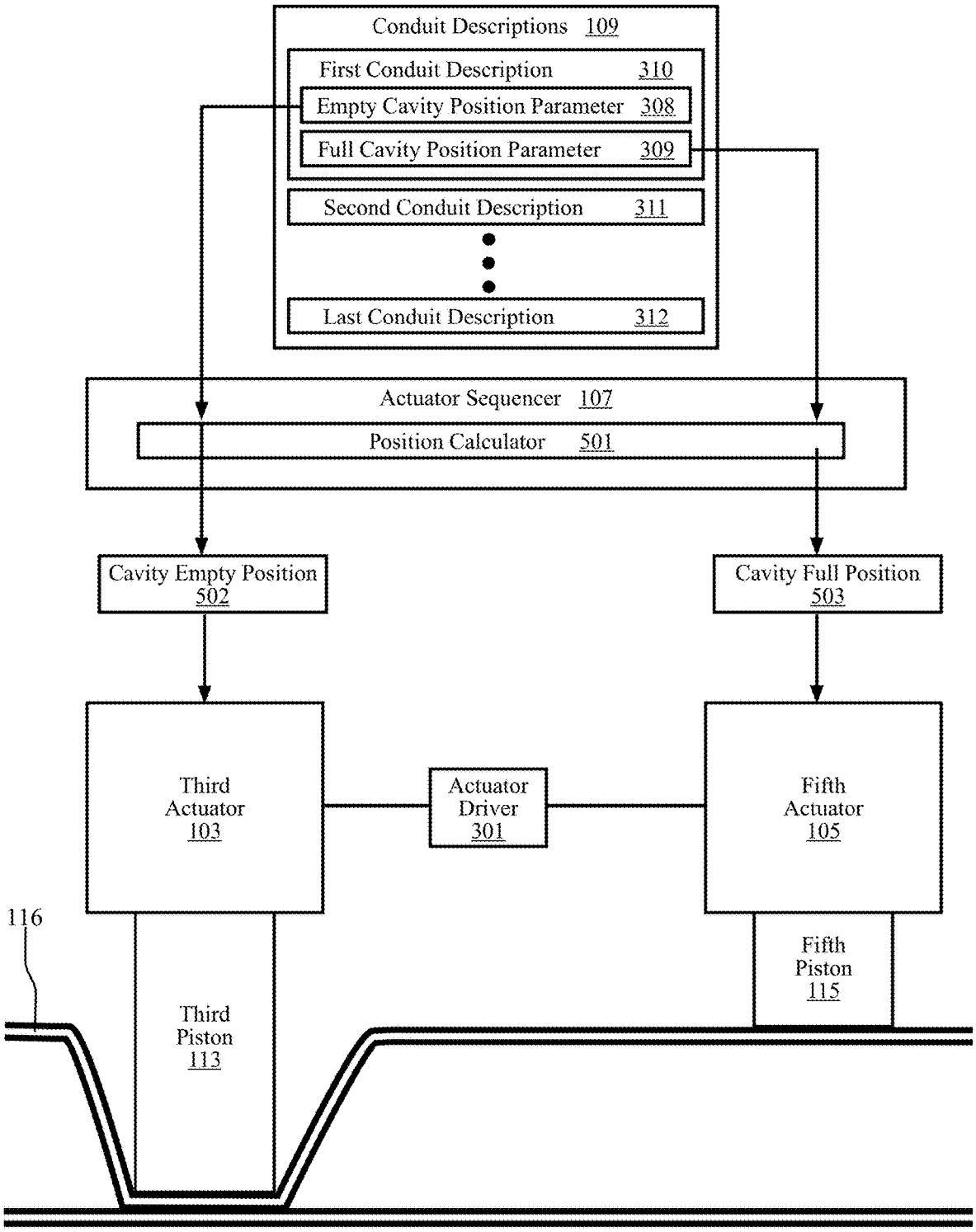
FIG. 5 is a high level block diagram illustrating an example of using a conduit description to control piston positions, according to some aspects.

FIG. 5 is a high level block diagram illustrating an example of using a conduit description to control piston positions, according to some aspects. At a certain point in the pumping sequences, the actuator sequencer may send the third piston 113 to a cavity empty position 502 and may send the fifth piston 115 to a cavity full position 503. A position calculator 501 may use the empty cavity position parameter 308 to determine the cavity empty position 502. In some examples, the empty cavity position parameter 308 indicates the cavity empty position. (e.g., cavity empty position equals empty cavity position parameter). In another example the cavity empty position is calculated using the empty cavity position parameter 308. The position calculator 501 may use the full cavity position parameter 309 to determine the cavity full position 503. In some examples, the full cavity position parameter 309 indicates the cavity full position. (e.g., cavity full position equals full cavity position parameter). In another example the cavity full position is calculated using the full cavity position parameter 309. The third actuator may be commanded to move the third piston to the cavity empty position. For example, a "move-to cavityEmptyPosition" command may send the actuator to the cavity empty position. The fifth actuator may be commanded to move the fifth piston to the cavity full position. For example, a "move-to cavityFullPosition" command may send the actuator to the cavity empty position.

Figure 6:
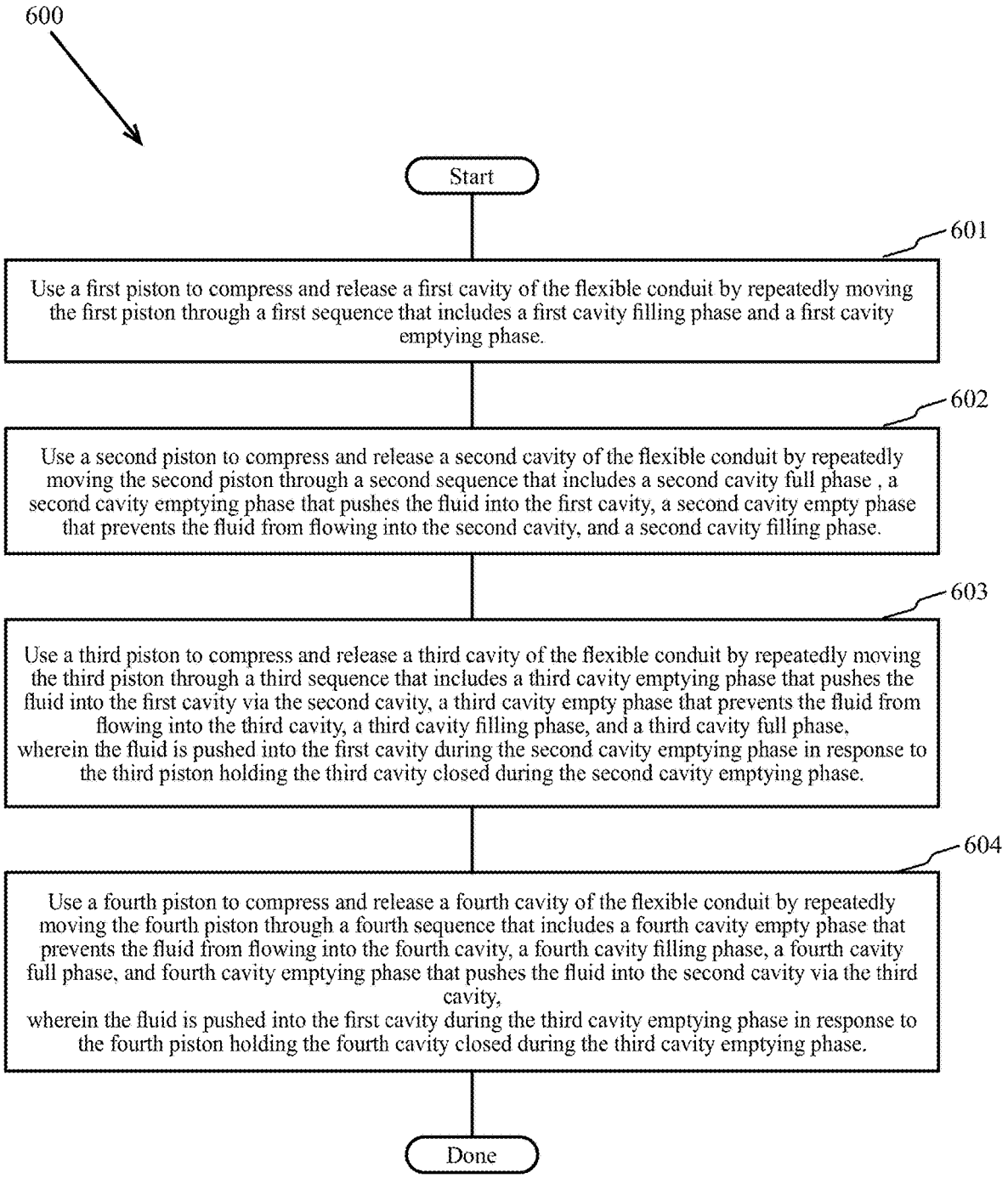
FIG. 6 is a high level block diagram illustrating an example of a method for using a peristaltic pump to pump fluid with reduced pulses, according to some aspects.

FIG. 6 is a high level block diagram illustrating an example of a method for using a peristaltic pump to pump fluid with reduced pulses 600, according to some aspects. At block 601, a first piston can compress and release a first cavity of the flexible conduit by repeatedly moving the first piston through a first sequence that includes a first cavity filling phase and a first cavity emptying phase. At block 602, a second piston can compress and release a second cavity of the flexible conduit by repeatedly moving the second piston through a second sequence that includes a second cavity full phase, a second cavity emptying phase that pushes the fluid into the first cavity, a second cavity empty phase that prevents the fluid from flowing into the second cavity, and a second cavity filling phase. At block 603, a third piston can compress and release a third cavity of the flexible conduit by repeatedly moving the third piston through a third sequence that includes a third cavity emptying phase that pushes the fluid into the first cavity via the second cavity, a third cavity empty phase that prevents the fluid from flowing into the third cavity, a third cavity filling phase, and a third cavity full phase, wherein the fluid is pushed into the first cavity during the second cavity emptying phase in response to the third piston pressing the third cavity closed during the second cavity emptying phase. At block 604, a fourth piston can compress and release a fourth cavity of the flexible conduit by repeatedly moving the fourth piston through a fourth sequence that includes a fourth cavity empty phase that prevents the fluid from flowing into the fourth cavity, a fourth cavity filling phase, a fourth cavity full phase, and fourth cavity emptying phase that pushes the fluid into the second cavity via the third cavity, wherein the fluid is pushed into the first cavity during the third cavity emptying phase in response to the fourth piston pressing the fourth cavity closed during the third cavity emptying phase. Blocks 601, 602, 603, and 604 may be executed simultaneously.

Although the operations of the method(s) herein are shown and described in a particular order, the order of the operations of each method may be altered so that certain operations may be performed in an inverse order or so that certain operations may be performed, at least in part, concurrently with other operations. Instructions or sub-operations of distinct operations may be implemented in an intermittent and/or alternating manner.

It may also be noted that at least some of the operations for the methods described herein may be implemented using software instructions stored on a computer usable storage medium for execution by a computer. For example, a computer program product can include a computer usable storage medium to store a computer readable program.

Although specific examples have been described and illustrated, the scope of the claimed systems, methods, devices, etc. is not to be limited to the specific forms or arrangements of parts so described and illustrated. The scope may be defined by the claims appended hereto and their equivalents.

What is claimed is:

1. A system comprising:

an anvil operable to support a flexible conduit having a first cavity and a second cavity;

a first piston operable to pump a fluid through the first cavity by repeatedly moving through a first sequence that includes a first cavity filling phase and a first cavity emptying phase;

a second piston operable to pump the fluid through the second cavity by repeatedly moving through a second sequence that includes a second cavity full phase, a second cavity emptying phase that pushes the fluid into the first cavity, a second cavity empty phase that prevents the fluid from flowing into the second cavity, and a second cavity filling phase;

a third piston operable to pump the fluid through a third cavity of the flexible conduit by moving through a third sequence that includes a third cavity emptying phase that pushes the fluid into the first cavity via the second cavity, a third cavity empty phase that prevents the fluid from flowing into the third cavity, a third cavity filling phase, and a third cavity full phase; and a fourth piston operable to pump the fluid through a fourth cavity of the flexible conduit by moving through a fourth sequence that includes a fourth cavity empty phase that prevents the fluid from flowing into the fourth cavity, a fourth cavity filling phase, a fourth cavity full phase, and fourth cavity emptying phase that pushes the fluid into the second cavity via the third cavity, wherein:

the first piston and the second piston are operable to compress the flexible conduit by pressing the flexible conduit against the anvil;

the first sequence is a two phase sequence; and the fluid is pushed into the first cavity during the third cavity emptying phase in response to the fourth piston pressing the fourth cavity closed during the third cavity emptying phase.

2. The system of claim 1, wherein the second cavity full phase and the second cavity emptying phase coincide with the first cavity filling phase.

3. The system of claim 2, wherein the second cavity filling phase does not coincide with the first cavity filling phase.

4. The system of claim 1, wherein:

the fluid is pushed into the first cavity during the second cavity emptying phase in response to the third piston holding the third cavity closed during the second cavity emptying phase.

5. The system of claim 1, further including:

a fifth piston operable to pump the fluid through a fifth cavity of the flexible conduit by moving through a fifth sequence that includes a fifth cavity filling phase, a fifth cavity full phase, a fifth cavity emptying phase that pushes the fluid into the third cavity via the fourth cavity, and a fifth cavity empty phase that prevents the fluid from flowing into the fifth cavity.

6. The system of claim 5, wherein:

the fluid is pushed into the second cavity during the fourth cavity emptying phase in response to the fifth piston holding the fifth cavity closed during the fourth cavity emptying phase.

7. The system of claim 5, wherein:

the third cavity emptying phase coincides with the second cavity full phase, the fourth cavity empty phase, and the fifth cavity filling phase;

the second cavity emptying phase coincides with the third cavity empty phase, the fourth cavity filling phase, and the fifth cavity full phase; and the third cavity emptying phase and the second cavity emptying phase coincide with the first cavity filling phase.

8. The system of claim 1, further including:

an actuator operable to apply an actuator force to a piston to move the piston to a cavity empty position;

a force sensor operable to produce a measurement of the actuator force; and an actuator calibrator operable to use the measurement of actuator force to determine an empty cavity position parameter that indicates the cavity empty position.

9. The system of claim 1, further including:

a memory operable to store a plurality of conduit descriptions that includes a conduit description that is associated with the flexible conduit; and an actuator sequencer operable to control an actuator that moves the first piston to a cavity empty position and to a cavity full position, wherein:

the conduit description that is associated with the flexible conduit includes an empty cavity position parameter and a full cavity position parameter; and the actuator sequencer is operable to use the empty cavity position parameter to determine the cavity empty position and to use the full cavity position parameter to determine the cavity full position.

10. A method for pumping a fluid through a flexible conduit, the method comprising:

using a first piston to compress and release a first cavity of the flexible conduit by repeatedly moving the first piston through a first sequence that includes a first cavity filling phase and a first cavity emptying phase; and using a second piston to compress and release a second cavity of the flexible conduit by repeatedly moving the second piston through a second sequence that includes a second cavity full phase, a second cavity emptying phase that pushes the fluid into the first cavity, a second cavity empty phase that prevents the fluid from flowing into the second cavity, and a second cavity filling phase;

using a third piston to compress and release a third cavity of the flexible conduit by repeatedly moving the third piston through a third sequence that includes a third cavity emptying phase that pushes the fluid into the first cavity via the second cavity, a third cavity empty phase that prevents the fluid from flowing into the third cavity, a third cavity filling phase, and a third cavity full phase; and using a fourth piston to compress and release a fourth cavity of the flexible conduit by repeatedly moving the fourth piston through a fourth sequence that includes a fourth cavity empty phase that prevents the fluid from flowing into the fourth cavity, a fourth cavity filling phase, a fourth cavity full phase, and fourth cavity emptying phase that pushes the fluid into the second cavity via the third cavity, wherein:

the third cavity emptying phase coincides with the second cavity full phase, and the fourth cavity empty phase;

the second cavity emptying phase coincides with the third cavity empty phase, and the fourth cavity filling phase; and the third cavity emptying phase and the second cavity emptying phase coincide with the first cavity filling phase.

11. The method of claim 10, wherein the fluid is pushed into the first cavity during the second cavity emptying phase in response to the third piston pressing the third cavity closed during the second cavity emptying phase.

12. The method of claim 11, wherein the fluid is pushed into the first cavity during the third cavity emptying phase in response to the fourth piston holding the fourth cavity closed during the third cavity emptying phase.

13. The method of claim 10, further including:

applying an actuator force to a piston to move the piston to a cavity empty position;

producing a measurement of the actuator force; and using the measurement of actuator force to determine an empty cavity position parameter that indicates the cavity empty position.

14. The method of claim 13, further including:

storing a conduit description that is associated with the flexible conduit and that includes the empty cavity position parameter and a full cavity position parameter;

using the empty cavity position parameter to determine the cavity empty position for the first piston; and using the full cavity position parameter to determine a cavity full position for the first piston.

15. A system comprising:

a first pumping means for compressing and releasing a first cavity of a flexible conduit in a first sequence that includes a first cavity filling phase and a first cavity emptying phase; and a second pumping means for compressing and releasing a second cavity of the flexible conduit by repeatedly moving through a second sequence that includes a second cavity full phase, a second cavity emptying phase that pushes a fluid into the first cavity, a second cavity empty phase that prevents the fluid from flowing into the second cavity, and a second cavity filling phase;

a third pumping means for compressing and releasing a third cavity of the flexible conduit by repeatedly moving through a third sequence that includes a third cavity emptying phase that pushes the fluid into the first cavity via the second cavity, a third cavity empty phase that prevents the fluid from flowing into the third cavity, a third cavity filling phase, and a third cavity full phase; and fourth pumping means for compressing and releasing a fourth cavity of the flexible conduit by repeatedly moving through a fourth sequence that includes a fourth cavity empty phase that prevents the fluid from flowing into the fourth cavity, a fourth cavity filling phase, a fourth cavity full phase, and fourth cavity emptying phase that pushes the fluid into the second cavity via the third cavity, wherein:

the third cavity emptying phase coincides with the second cavity full phase, and the fourth cavity empty phase;

the second cavity emptying phase coincides with the third cavity empty phase, and the fourth cavity filling phase; and the third cavity emptying phase and the second cavity emptying phase coincide with the first cavity filling phase.

* * * * *